US008066285B2

(12) United States Patent
Gottlieb

(10) Patent No.: US 8,066,285 B2
(45) Date of Patent: Nov. 29, 2011

(54) WAGERING METHOD AND APPARATUS BASED ON A NUMERICAL TOTAL

(76) Inventor: Ted Gottlieb, Lake Tahoe, NV (US)

( * ) Notice: Subject to any disclaimer, the term of this patent is extended or adjusted under 35 U.S.C. 154(b) by 186 days.

(21) Appl. No.: 11/868,153

(22) Filed: Oct. 5, 2007

(65) Prior Publication Data

US 2009/0091081 A1 Apr. 9, 2009

(51) Int. Cl.
*A63F 1/00* (2006.01)

(52) U.S. Cl. ..... 273/292; 463/13

(58) Field of Classification Search ..... 273/292; 463/13

See application file for complete search history.

(56) References Cited

U.S. PATENT DOCUMENTS

| | | | | |
|---|---|---|---|---|
| 5,685,774 | A | 11/1997 | Webb | |
| 6,877,748 | B1 * | 4/2005 | Patroni et al. | 273/292 |
| 7,322,578 | B2 * | 1/2008 | Swartz et al. | 273/292 |
| 2004/0075215 | A1 * | 4/2004 | Snow et al. | 273/292 |
| 2007/0241507 | A1 * | 10/2007 | Ko et al. | 273/292 |
| 2007/0284822 | A1 * | 12/2007 | Banh | 273/292 |
| 2008/0108412 | A1 * | 5/2008 | Snow et al. | 463/20 |
| 2008/0237984 | A1 * | 10/2008 | Kling et al. | 273/292 |

* cited by examiner

*Primary Examiner* — Gene Kim
*Assistant Examiner* — Michael Dennis
(74) *Attorney, Agent, or Firm* — Muskin & Cusick LLC

(57) ABSTRACT

A wagering game that deals a hand to a player and a dealer. A numerical total of the player's hand is compared to a numerical total of the dealer's hand in order to determine which hand, the player's or the dealer's, is higher (and hence the winner). Before reaching the comparison, the player must make at least one additional raise wager(s) before being dealt an additional card(s).

3 Claims, 3 Drawing Sheets

WAGERING METHOD AND APPARATUS BASED ON A NUMERICAL TOTAL

BACKGROUND OF THE INVENTION

1. Field of the Invention

The present inventive concept relates to a wagering game, and more particularly to a game which allows the player to compare a numerical total of the player's hand against a dealer's hand.

2. Description of the Related Art

Casino table games are a major industry. Casinos are always interested in adding new and profitable variants of table games in order to provide their players with additional excitement and variety.

SUMMARY OF THE INVENTION

It is an aspect of the present invention to provide an exciting wagering game with multiple player betting opportunities.

The above aspects can be obtained by a method that includes (a) providing a deck(s) of cards; (b) receiving an initial wager from a player; (c) dealing, from the deck(s), an initial player's hand, wherein the player views the initial player's hand; (d) raising or folding, by the player, wherein if the player raises then the player places a first raise wager and if the player does not raise then the player does not place the first raise wager; (e) dealing, from the deck(s), a further card(s) to the player to form an intermediate player's hand comprised of the initial player's hand and the further card(s), wherein the player views the further card(s); (f) raising or folding, by the player, wherein if the payer raises then the player places a second raise wager and if the player does not raise then the player does not place the second raise wager; (g) dealing, from the deck(s), a final card(s) to the player to form a final player's hand comprised of the intermediate player's hand and the final card(s), wherein the player views the final card(s); (h) revealing a dealer's hand; (i) determining if the player placed both the first raise wager and the second raise wager, and if so, then performing j, k and l, and if not, then taking, from the player, the initial wager and any first raise wager placed and the second raise wager placed; (j) summing all cards in the final player's hand into a player point total; (k) summing all cards in the dealer's hand into a dealer point total; (l) determining if the player point total is greater than the dealer point total, and if so, then paying a payout to the player.

The above aspects can also be obtained by a method that includes (a) providing a deck(s) of cards; (b) receiving an initial wager from a player; 9*c*) dealing, from the deck(s), an initial player's hand, wherein the player views the initial player's hand; (d) raising or folding, by the player, wherein if the player raises then the player places a first raise wager and if the player does not raise then the player does not place the first raise wager; (e) dealing, from the deck(s), a further card(s) to the player to form a final player's hand comprised of the initial player's hand and the further card(s), wherein the player views the further card(s); (f) revealing a dealer's hand; (g) determining if the player placed the first raise wager, and if so, then performing h, i and j, and if not, then taking, from the player, the initial wager; (h) summing all cards in the final player's hand into a player point total; i) summing all cards in the dealer's hand into a dealer point total; and j) determining if the player point total is greater than the dealer point total, and if so, then paying a payout to the player.

The above aspects can also be obtained by a method that includes (a) providing a deck(s) of cards; (b) receiving an initial wager from a player; (c) forming, from the deck(s), both a player's hand and a dealer's hand; (d) revealing both the player's hand the dealer's hand; (e) determining if the player's hand qualifies by evaluating the player's hand; (f) if the player's hand qualifies, then comparing the player's hand to the dealer's hand, and if the player's hand beats the dealer's hand according to evaluation criteria, then the player wins a payout on the initial wager and if the dealer's hand beats the player's hand then the player loses the initial wager; and (g) if the player's hand does not qualify, then comparing the player's hand to the dealer's hand according to evaluation criteria, and if the player's hand beats the dealer's hand, then the player pushes on the initial wager, and if the player's hand does not beat the dealer's hand then the player loses the initial wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
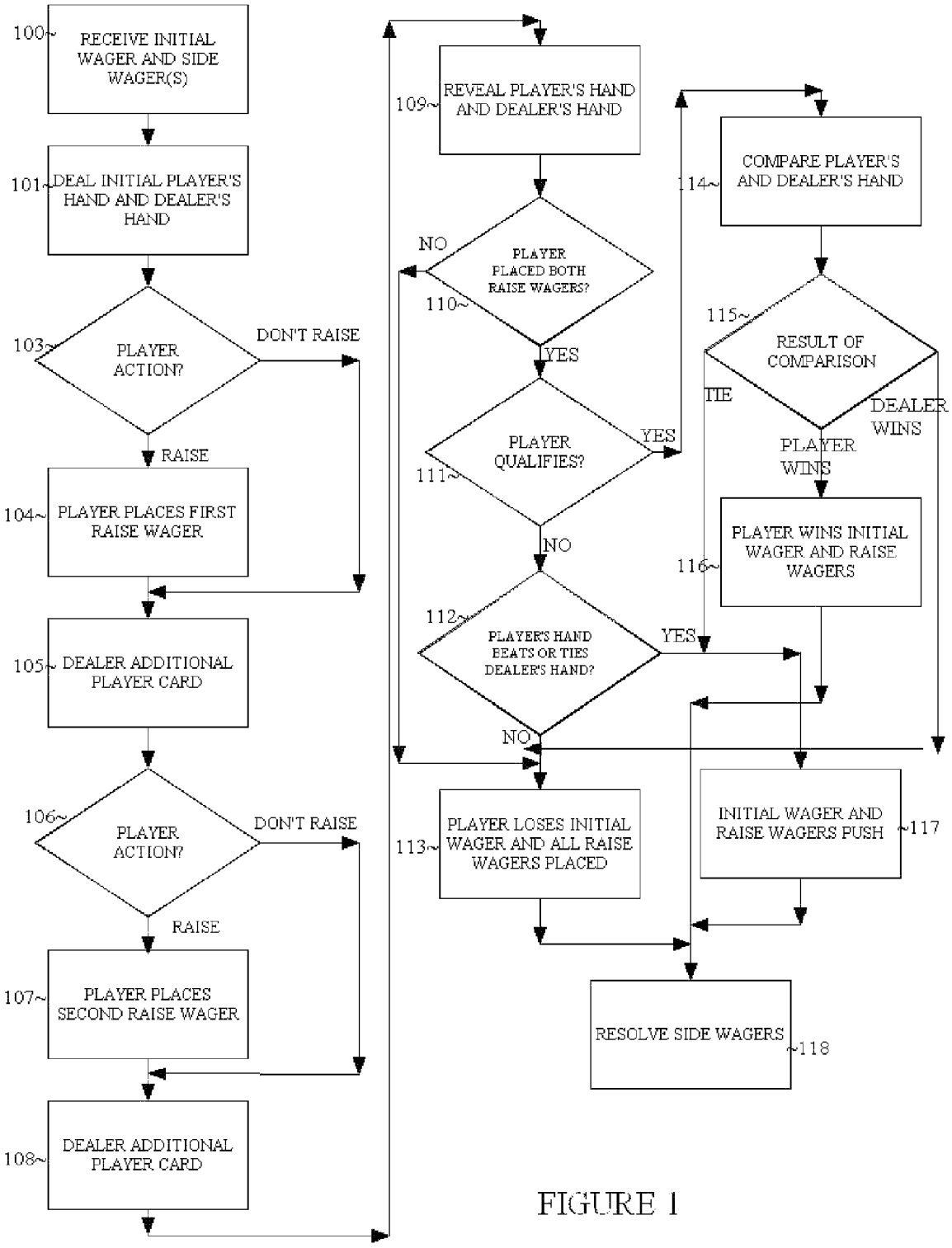
FIG. 1 is a flowchart illustrating an exemplary method of implementing a wagering game, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which implements a card game. A player makes a wager and is dealt a player's hand in which the player hopes will beat a dealer's hand in order to get paid on the wager.

FIG. 1 is a flowchart illustrating an exemplary method of implementing a wagering game, according to an embodiment.

The method can start with operation 100, which receives an initial wager and side wager(s) from the player. The initial wager is mandatory and is required for the player to enter the game. The player typically places the wager by placing chips in a betting circle on a gaming table. A poker side wager can be placed which is paid based on a final poker rank of the player's hand. A sum side wager can be placed which is paid based on a sum total of ranks in the player's hand. More on both of these side wagers will be explained below in more detail. Depending on the variation currently being implemented (house rules): both the poker side wager and the sum side wager can be required; or both the poker side wager and the sum side wager can be optional; or the poker side wager can be required and the sum side wager can be option; or the poker side wager can be optional and the sum side wager can be required.

From operation 100, the method can proceed to operation 101, which deals an initial player's hand and an initial dealer's hand. In an embodiment, the initial player's hand will be three cards and the initial dealer's hand will be three cards, although of course in other embodiments different numbers of cards can be used. Typically, the initial dealer's hand will be dealt face down. The initial player's hand can be dealt face down or face up, depending on the embodiment being implemented.

From operation 101, the method proceeds to operation 103, which determines whether the player chooses to raise. If the player does not wish to raise, then the player will forfeit his or her initial wager, however the player will not be required to make any further wagers and the player will still be eligible to receive payouts on any side wager(s) the player has placed. Typically, the player will decide not to raise (fold) if the player has a bad initial player's hand. The player would make this determination based on the three cards in the initial player's hand. If in operation 103, the player decides not to raise, then the method proceeds to operation 105.

The player can indicate to the dealer the player's choice of actions, for example, if the player wishes to fold, the player can place his cards in a particular playing area on the table, and if the player wishes to raise the player can place his or her cards in a different area on the table. Place the raise wager is also an indication to the dealer that the player wishes to raise. The player can also verbally indicate to the player his or her desired course of action and/or use hand signals as well.

If in operation 103, the player decides to raise, then the method proceeds to operation 104, wherein the player places a first raise wager. The first raise wager is required to be equal in amount to the initial wager. In an alternative embodiment, the first raise wager can be a different amount than the initial wager (e.g., higher or lower). From operation 104, the method can proceed to operation 105.

In operation 105, the dealer deals an additional player card (or in an alternative embodiment, cards), either face up or face down depending on the house rules (the embodiment being implemented). The dealer will also deal an additional card to the dealer's hand as well (typically face down).

From operation 105, the method can proceed to operation 106, which determines whether the player wishes to raise or not. The player now has four cards in what is now the player's hand (the player's initial hand plus the card dealt to the player in operation 105). The player uses these four cards to make the determination whether to raise or not. Typically, if the player believes he or she has a good hand, then the player would raise. If the player decides not to raise in operation 105, then the method can proceed to operation 108.

If the determination in operation 106 determines that the player decides to rise, then the method proceeds to operation 107, wherein the player places a second raise wager. The second raise wager is required to be equal in amount to the initial wager. In an alternative embodiment, the second raise wager can be a different amount than the initial wager (e.g., higher or lower). It is noted that if the player did not raise in operation 103 (e.g., the player folded), then the player would typically not be allowed to raise in operation 106.

From operation 107, the method can proceed to operation 108, which deals an additional player card (or alternatively cards). The card can either be dealt face up or face down, depending on the current embodiment being implemented. The dealer can also deal himself another card (typically face down).

From operation 108, the method proceeds to operation 109, which reveals (turns face up) both the player's hand and the dealer's hand. At this point, enough information is on the table to determine a payout on all of the wager(s) made.

From operation 109, the method proceeds to operation 110, which determines whether the player has placed both raise wagers (in operations 104 and 107). Only if the player has placed both raise wagers is the player eligible to win on the initial wager placed in operation 100 and any raise wager(s) that the player may have placed (in operations 104 and 107). For example, if the player did not raise in operation 103, or if the player raised in operation 103 but did not raise in operation 106, then the player will lose the initial wager and any raise wagers placed. Thus player must make three bets (the initial wager, the first raise wager, and the second raise wager) in order for the player to be eligible to win a payout on these wagers.

Thus, if operation 110 determines that the player did not place both raise wagers, then the method proceeds to operation 113, wherein the player loses the initial wager and any and all raise wagers (from operations 104 and 107) that the player may have placed.

If operation 110 determines that the player did place both raise wagers, then the method can proceed to operation 111, which determines whether the player's hand qualifies. This can be done according to any predetermined criteria. For example, if the player's hand point total exceeds a predetermined point total (e.g., at least 31), the player will qualify. Aces can count as ones (although in alternative embodiment aces can count as 11) and all face cards can have a point value of 10.

If the determination in operation 111 determines that the player does not qualify, then the method proceeds to operation 112 which determines whether the player's hand beats or ties the dealer's hand. This can be done by summing a point total of the player's hand and comparing it to a point total of the dealer's hand, wherein the highest point total wins. In the method has reached 112 (which means both raise wagers were placed), the player should typically have an equal number of cards that the dealer has. If the player's hand neither beats the dealer's hand nor ties the dealer's hand (in other words the player's point total is less than the dealer's point total), then the method can proceed to operation 113.

If in operation 112, the player's hand beats or ties the dealer's hand (e.g., the player's point total is greater than equal to the dealer's point total), then the method can proceed to operation 117, wherein the initial wager and the raise wagers all push (neither win or lose). This can be considered a "consolation prize" to the player.

If operation 111 determines that the player qualifies, then the method can proceed to operation 114, which compares the player's hand and the dealer's hand. This can be done by adding a point total of the player's hand and adding a point total of the dealer's hand, and comparing the two. If the two are equal, the result is a tie. If the player's point total is higher than the dealer's point total, then the player wins. If the dealer's point total is higher than the player's point total, then the dealer wins (the player loses).

If the result of the comparison from operation 115 is a tie between the player's hand and the dealer's hand, then the method can proceed to operation 117, wherein the initial wager and the raise wagers all push.

If the result of the comparison from operation 115 is that the player wins, then the method can proceed to operation 116, wherein the player wins a payout based on the initial wager and the raise wagers. The payout on the initial wager and the raise wagers can be even money (e.g., 1:1) or another multiple.

If the result of the comparison from operation 115 is that the dealer wins, then the method can proceed to operation 113, wherein the player loses the initial wager and both raise wagers placed.

From operations 113, 116, and 117, the method can now proceed to operation 118, which resolves all side wagers placed. For example, the sum side wager can be resolved by adding a point total of all player's cards and comparing them to a paytable to determine the payout amount. Table I illustrates one example of such a paytable.

TABLE I

| Point total | payout |
|---|---|
| 6 | 50:1 |
| 7-21 | 1:1 |
| 40-43 | 1:1 |
| 44 | 3:1 |
| 45 | 4:1 |
| 46 | 6:1 |
| 47 | 10:1 |
| 48 | 15:1 |
| 49 | 25:1 |
| 50 | 50:1 |

The sum point can be determined by adding all of the values of each card in the player's hand. Aces can count as 1, and face cards can count as 10. Thus, for example, if the player's hand is: Queen, ten, nine, eight, and five, this is a point total of 42, which has a payout of 1:1. Thus, a $1 bet on the sum side wager would pay $1 (thus the player would have won $1 profit on the sum side wager). If the player bet $1 on the sum side wager and was dealt: Queen, eight, five, three, ace, this would be a point total of 27, wherein the player would lose the $1 sum side wager.

The poker side wager can pay on a poker rank of the player's final cards. Table II below illustrates one possible paytable of ranks and respective payouts.

TABLE II

| | |
|---|---|
| Royal flush | 500:1 |
| Straight flush | 100:1 |
| 4 aces, 2's, 3's, or 4's | 100:1 |
| 4 5's-kings | 50:1 |
| full house | 30:1 |
| flush | 15:1 |
| straight | 7:1 |
| 3 of a kind | 4:1 |
| two pair | 2:1 |
| pair of 9's or better | 1:1 |
| less than queen-high | 1:1 |

It is noted that the dealer's cards can be dealt at any time. For example, all of the dealer's cards can be dealt in operation 101, or they all can be dealt in operation 109, or the initial dealer's cards can be dealt in operation 101, and successive dealer's card(s) can be dealt in operations 105 and 108. In fact, cards can be dealt in any order and wagers can be accepts and paid in any order, as long as the spirit and scope of the game does not change.

Different numbers of cards can be used. In a preferred embodiment, the initial player hand will consist of three cards, and an additional card will be dealt in each of operations 105 and 108. The number of cards in the dealer's final hand (all the cards used to determine the dealer's point total) should equal the number of cards in the player's final hand (all of the cards used to determine the player's point total).

The optimal strategy for a player to follow (with the rules as follows: the player qualifying point total is at least 31, the player's final hand and the dealer's final hand is composed of five cards, the player is dealt three cards initially, and then one more and then one more) is: 1) if the player's first three cards (the player's initial hand) totals less than 17, then fold (in operation 103). If the player's first four cards totals less than 21, then fold (in operation 106). Of course, other sets of rules can be used as well, such as other player qualifying point totals, numbers of cards, etc. For example, the player can be dealt two cards (operation 101), then dealt two further cards (operation 105) after a raise, then dealt a single further card (operation 108) after another raise. There can be a large number of variants, each of which nevertheless embodies the underlying general concept. Different qualifying point totals can be used as well (e.g., the players point total needs to be greater than 25, greater than or equal to 40, etc.)

Figure 2:
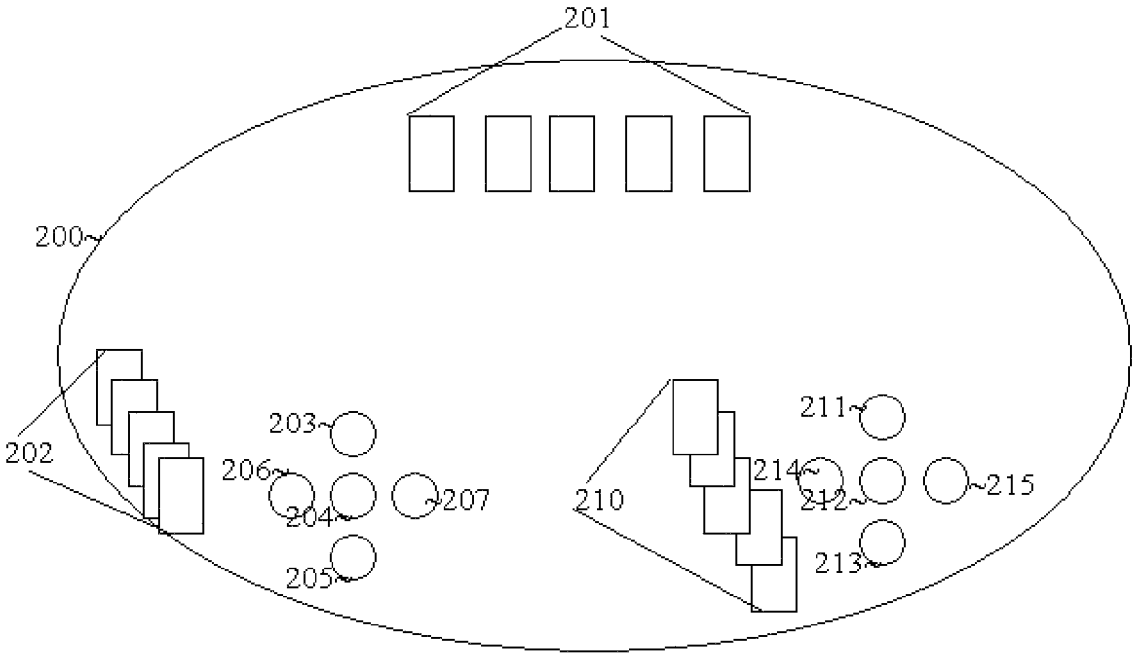
FIG. 2 is an exemplary table layout to implement a wagering game, according to an embodiment.

FIG. 2 is an exemplary table layout to implement a wagering game, according to an embodiment.

A gaming table 200 is a standard casino gaming table which has legs and a table felt. The table 200 shown accommodates two simultaneous players, although of course such a table can accommodate any number of players (e.g., 1-10). A dealer's hand 201 is shown, along with a first player's hand 202. The first player also has five adjacent betting circles, comprising a first player's initial wager circle 203, a first player's first raise wager circle 204, a first player's second raise wager circle 205, a first player's sum side bet 206 and a first player's poker side bet 207.

A second player's hand 210 is illustrated alongside a second player's initial wager betting circle 211, a second player's first raise wager betting circle 212, a second player's second raise wager betting circle 213, a second player's sum side bet 214, and a second player's poker side bet 215.

Some examples of the game will now be presented, using the paytables in Table I and Table II for the sum side bet and the poker side bet, respectively. Joe bets $1 on the initial wager, $1 on the poker side bet, and $1 on the sum side bet. John bets $1 on the initial wager, $1 on the poker side bet, and $1 on the sum side bet. Jen bets $2 on the initial wager, $1 on the sum side bet, and decides not to bet the poker side bet.

The dealer now deals Joe an initial hand of queen hearts/three clubs/nine diamonds. The dealer deals John an initial hand of five spades/ten hearts/two diamonds. The dealer deals Jen jack spades/jack clubs/two hearts. The dealer also deals himself three cards face down so that nobody can see them. Of course the cards can actually be dealt in any order.

Joe has a point total of 22. Joe decides to continue playing (raise) and places a $1 first raise wager. John has a point total of 17 and decides to fold, thus john does not place a first raise wager and indicates to the dealer he does not wish to place this bet (by telling the dealer or using a hand signal). Jen has a point total of 22 Jen decides to raise by placing a $2 first raise wager.

The dealer now deals Joe an four of clubs, deals John a three of hearts, deals Jen a queen of spades, and deals himself an additional card face down. Joe now has a point total of 26. Joe decides to fold and does not place a second raise wager. John had previously folded and thus cannot place the second raise wager (even if John wanted to). However, John may still be able to win on his side bets once all of the cards are dealt and that is why he can continue to receive cards. John's current point total is 20. Jen now has a point total of 32. Jen decides to raise by placing a $2 second raise wager.

The dealer now deals Joe an ace of hearts, deals John a king of diamonds, deals Jen a king of clubs, and deals himself an additional card face down. The dealer now reveals all of the cards in the dealer's hand (the initial dealer's hand and all additional cards dealt to the dealer). The dealer reveals his hand to be: six clubs/seven hearts/two clubs/ace clubs/nine hearts. This dealer's point total is thus 25.

Joe now has a point total of 27. From Table I, 27 is not a paying point total, and thus Joe loses his sum side wager. Since Joe did not raise both times (by placing the first raise wager and the second raise wager in operations 103 and 106), Joe loses his initial wager and first raise wager. Even though Joe would qualify (since his point total is at least 31), this does not matter since Joe did not stay in the game (since he did not place both raise wagers). Joe's final hand is: queen hearts/three clubs/nine diamonds/four clubs/ace hearts. Joe has not made a paying poker hand as per Table II. Thus, Joe has lost his initial wager, his sum side wager, his poker side wager, and his first raise wager.

Since John folded John loses his initial wager. John's final hand is: of five spades/ten hearts/two diamonds/three hearts/king diamonds. John's final point total is 30. 30 is not a paying point total according to Table I. Jon also does not have a paying poker hand according to Table II. Thus John loses his initial wager, his sum side wager, and his poker side wager. Even if John's point total qualified and beat the dealer's point total (e.g., if John had a point total of 40), since John did not place both raise wagers John would have lost his initial wager anyway.

Jen's final hand is: jack spades/jack clubs/two hearts/queen spades/king clubs. Jen's point total is 42. Since Jen placed both raise wagers Jen is now eligible to go against the dealer and potentially win payouts on her initial wager, first raise wager, and second raise wager. Since Jen's point total is greater than or equal to 31 (at least 31), Jen qualifies. Jen's point total (42) is greater than the dealer's point total (25). Thus, Jen wins a payout (even money or other payout) on all of her initial wager first raise wager, and second raise wager. Since Jen has bet $2 on each of these wagers, Jen wins even money on each of these wagers which equals $6. According to Table I, a player point total of 42 pays 1:1. Thus Jen wins 1:1 or $1 on the sum side bet. Thus, in this game, Jen has bet $7 and won $7 (for a total of $14 in chips on the table). Jen's poker hand is a pair of jacks, which according to Table II, is a "pair of 9's or better" which pays 1:1. However, since Jen chose not to make the poker side wager, Jen does not win anything based on her poker hand.

If Jen was not able to qualify (her point total was not at least 31), then she would automatically lose her initial wager, first raise wager, and second raise wager. In a further embodiment, if Jen was not able to qualify, then she would automatically loser her initial wager, first raise wager, and second raise wager, unless Jen's point total was greater than the dealer's point total (or in another embodiment at least equal to the dealer's point total) then Jen's initial wager, first raise wager, and second raise wager would push (not lose, not win).

Figure 3:
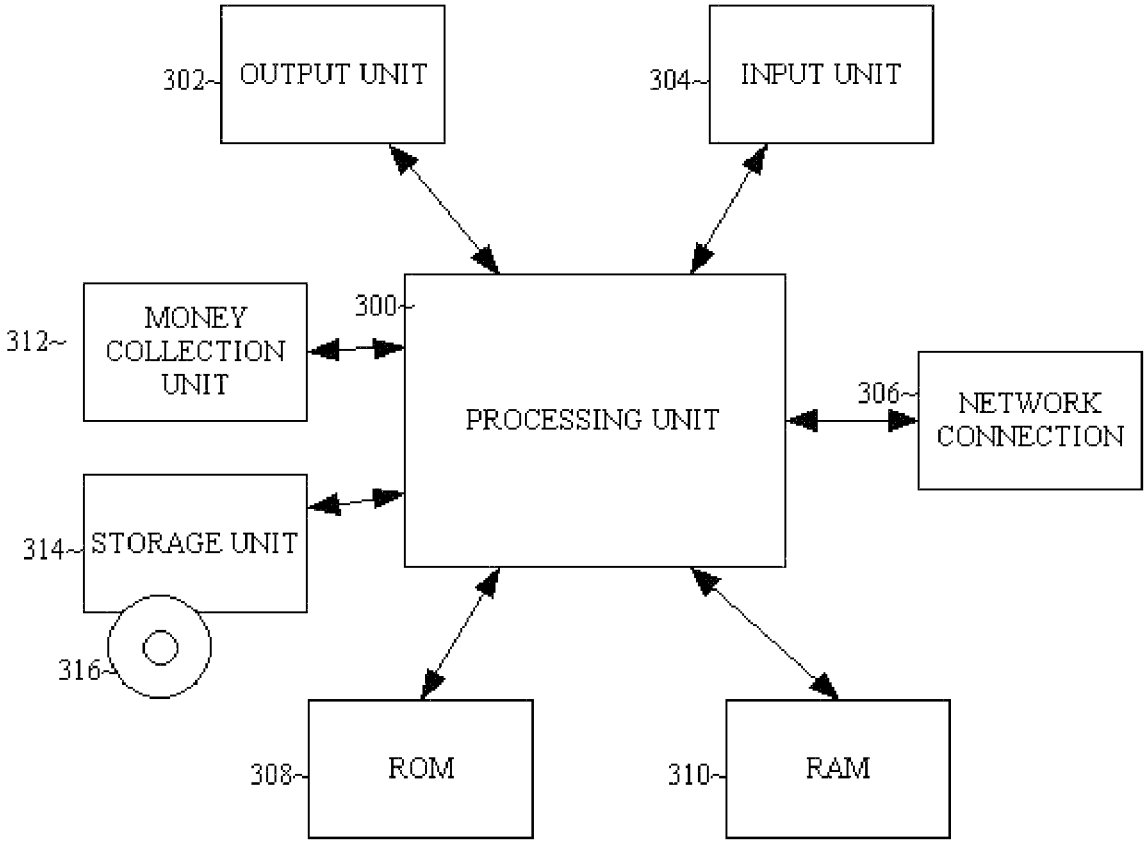
FIG. 3 is a block diagram illustrating hardware that can be used to implement an electronic version of methods described herein, according to an embodiment.

FIG. 3 is a block diagram illustrating hardware that can be used to implement an electronic version of methods described herein, according to an embodiment.

A processing unit 300 can be a microprocessor and any related components. The processing unit is connected to an output unit 302 can be an electronic display (e.g., LCD, touch screen display, CRT, etc.), an input unit 304 (which can be buttons, a touch screen display, a computer mouse, etc.), a network connection 306 to connect to a computer communications network (such as the Internet or LAN), a RAM 310, a ROM 308, a storage unit 314 (e.g., a CD-ROM, hard drive, etc.) a which can read a computer readable storage medium 316 (e.g., a CD-ROM) which can store instructions to control a computer to implement the methods described herein, and a money collection unit 312 which is used to receive cash and/or credits from the player and pay cash and/or credits to the player.

Moreover, while a player's hand is compared to a dealer's hand based on point totals of the hands, instead of using point totals, poker ranks can be substituted instead of point totals. For example, if a poker rank of the player's hand is greater than a poker rank of the dealer's hand, then the player would win, otherwise the dealer would win. In order to qualify, the player's hand would have to be a poker rank of a predetermined poker rank. Thus, hands can be evaluated and compared using either poker ranks or point totals, or any other evaluations criteria.

Any embodiments described herein can be played with a standard deck of cards or any type of special deck (e.g. a Spanish deck, etc.) The game can also be played with a single deck or multiple decks (e.g. 1-8 decks or more). Poker hands can be ranked as known in the art or as described herein. Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus to play a wagering game, the apparatus comprising:

an output device;

an input device;

a processing unit connected to the output device and the input device and executing instructions to perform a following operations:

receiving an initial wager from a player, while not receiving any bets from a dealer;

dealing, from a deck(s), an initial player's hand, wherein the player views the initial player's hand;

receiving a choice of raising or folding from the player, wherein if the player raises then a first raise wager is received from the player and if the player does not raise then the first raise wager is not received from the player;

dealing, from the deck(s), a further card(s) to the player to form an intermediate player's hand comprised of the initial player's hand and the further card(s), wherein the further card(s) are displayed to the player;

receiving a choice of raising or folding from the player, wherein if the player raises then a second raise wager is received from the player and if the player does not raise then the second raise wager is not received from the player, wherein if the player did not place the first raise wager then the player cannot place the second raise wager;

dealing, from the deck(s), a final card(s) to the player to form a final player's hand comprised of the intermediate player's hand and the final card(s), wherein the final card(s) are displayed to the player;

revealing a dealer's hand;

implementing predefined rules X and Y:

X) if the player placed both the first raise wager and the second raise wager then operations a, b and c would be performed: a) summing all cards in the final player's hand into a player numerical point total; b) summing all cards in the dealer's hand into a dealer numerical point total; c) resolving the initial wager and the first raise wager and the second raise wager based on a relationship between the player numerical point total and the dealer numerical point total wherein the initial wager and the first raise wager and the second raise wager all win together, all push together and all lose together, wherein after b, and before c, requiring that the player numerical point total is greater than a predetermined qualifying point total in order to proceed to c, wherein if the player numerical point total is not greater than the predetermined qualifying point total then the player loses the initial wager and the first raise wager and the second raise wager unless the player numerical point total is determined to be higher than or equal to the dealer numerical point total upon which the initial wager pushes and the first raise wager pushes and the second raise wager pushes;

Y) if the player did not place both the first raise wager and the second raise wager then the player's initial wager and any first raise wager placed and any second raise wager placed would all be taken from the player.

2. The apparatus as recited in claim 1, further comprising receiving a poker side wager from the player, and after the player's final hand is formed, paying the poker side wager based on a poker rank of the player's final hand, wherein the poker side wager is paid regardless of whether the player placed the first raise wager and regardless of whether the player placed the second raise wager.

3. The apparatus as recited in claim 1, further comprising receiving a sum side wager from the player, and after the player's final hand is formed, paying the sum side wager based on the player numerical point total, wherein the sum side wager is paid regardless of whether the player placed the first raise wager and regardless of whether the player placed the second raise wager.

* * * * *